US009301362B2

(12) United States Patent
Dohn et al.

(10) Patent No.: US 9,301,362 B2
(45) Date of Patent: Mar. 29, 2016

(54) LED DRIVER CIRCUIT

(75) Inventors: Alexander Dohn, Memmelsdorf (DE); Christian Schnagl, Höchstädt (DE); Alfred Thimm, Wunsiedel (DE); Karl Degelmann, Marktredwitz (DE); Ewald Sutor, Oberpframmen (DE)

(73) Assignee: CeramTec GmbH, Plochingen (DE)

( * ) Notice: Subject to any disclaimer, the term of this patent is extended or adjusted under 35 U.S.C. 154(b) by 319 days.

(21) Appl. No.: 13/879,055

(22) PCT Filed: Oct. 14, 2011

(86) PCT No.: PCT/EP2011/067959
§ 371 (c)(1),
(2), (4) Date: May 31, 2013

(87) PCT Pub. No.: WO2012/049283
PCT Pub. Date: Apr. 19, 2012

(65) Prior Publication Data

US 2013/0241425 A1 Sep. 19, 2013

(30) Foreign Application Priority Data

| | | |
|---|---|---|
| Oct. 15, 2010 | (DE) | 10 2010 042 485 |
| Jan. 7, 2011 | (DE) | 10 2011 008 065 |
| Jan. 7, 2011 | (DE) | 10 2011 012 672 |
| Apr. 8, 2011 | (DE) | 10 2011 016 502 |
| Apr. 8, 2011 | (DE) | 10 2011 016 503 |

(51) Int. Cl.

| | |
|---|---|
| ***H05B 37/00*** | (2006.01) |
| ***H05B 33/08*** | (2006.01) |
| ***F21K 99/00*** | (2010.01) |
| *F21Y 101/02* | (2006.01) |
| *F21V 29/77* | (2015.01) |

(52) U.S. Cl.
CPC ..... *H05B 33/0854* (2013.01); *F21K 9/13* (2013.01); *H05B 33/0842* (2013.01); *F21K 9/1375* (2013.01); *F21V 29/773* (2015.01); *F21Y 2101/02* (2013.01)

(58) Field of Classification Search
CPC ..... H05B 33/0854; H05B 41/2856; G09G 2320/041
USPC ..... 315/200 R, 309, 113, 291; 362/294, 362/373; 327/108–112, 378, 379, 512, 513; 326/82, 83, 87
See application file for complete search history.

(56) References Cited

U.S. PATENT DOCUMENTS 4,242,626 A * 12/1980 Gross ..... H02P 25/04 318/772
5,222,009 A * 6/1993 Scharnick ..... H02H 7/0822 318/782

(Continued)

FOREIGN PATENT DOCUMENTS

DE 20 2005 006 053 U1 6/2005
WO 2007/107601 A2 9/2007

*Primary Examiner* — Lincoln Donovan
*Assistant Examiner* — Thomas Skibinski
(74) *Attorney, Agent, or Firm* — Norton Rose Fulbright US LLP

(57) ABSTRACT

In order to supply power and control the power supplied to an LED (43), in particular an LED (43) comprising a ceramic support element (4, 32), an LED driver circuit (17) is designed to regulate the supply current for the LED (43) in accordance with the temperature of the support element (4, 32).

13 Claims, 12 Drawing Sheets

(56) References Cited

U.S. PATENT DOCUMENTS

| | | | | |
|---|---|---|---|---|
| 5,617,284 | A * | 4/1997 | Paradise | H02H 9/005 361/111 |
| 8,040,676 | B2 | 10/2011 | Kluge | |
| 2007/0170873 | A1 * | 7/2007 | Mishima | 315/291 |
| 2008/0079371 | A1 * | 4/2008 | Kang et al. | 315/309 |
| 2008/0258647 | A1 * | 10/2008 | Scianna | 315/291 |
| 2010/0096993 | A1 * | 4/2010 | Ashdown et al. | 315/113 |
| 2010/0103678 | A1 | 4/2010 | Van de Ven et al. | |
| 2010/0155766 | A1 | 6/2010 | Ku | |
| 2010/0213469 | A1 * | 8/2010 | Locke | 257/77 |
| 2014/0153305 | A1 * | 6/2014 | Pan et al. | H02M 1/4266 363/126 |

* cited by examiner retrofit R1
Assembly Top retrofit R1
Assembly Top

Bill of materials

HV9961 retrofit R1

HV9951 Phase Dimmable Buck LED Driver 350mA

| Item | Reference | Qty | Value | Description |
|---|---|---|---|---|
| 1 | C1,C2,C7 | 3 | 470nF | capacitor, ceramic HVC X7R 500V 10% -55...125°C |
| 2 | C3 | 1 | 1uF | capacitor, ceramic X7R 16V 20% -55...125°C |
| 3 | C4 | 1 | 220pF | capacitor, ceramic X7R 50V 5% -55...125°C |
| 4 | C5 | 1 | 2.2nF | capacitor, ceramic X7R 50V 10% -55...125°C |
| 5 | C6 | 1 | 100nF | capacitor, ceramic X7R 50V 10% -55...125°C |
| 6 | C8 | 1 | 10nF | capacitor, ceramic X7R 500V 10% -55...125°C |
| 7 | C9 | 1 | 4.7uF | capacitor, electrolytic KMG 400V 20% -40...+105°C |
| 8 | D1 | 1 | STTH1R06U | diode, Turbo 2 ultrafast, trr=25ns 600V 1A 175°C |
| 9 | D2 | 1 | S380 | bridge rectifier 380VAC 0.5A -55...150°C |
| 10 | D3,D5,D6 | 3 | BZX384-C68 | diode, Zener 68V 0.3W 5% -65...+150°C |
| 11 | D4 | 1 | RGL1J | diode, fast recovery trr=250ns 600V 1A -50...175°C |
| 12 | D7,D8,D9 | 3 | BZX384-C7V5 | diode, Zener 7.5V 0.3W 5% -65...+150°C |
| 13 | D10 | 1 | TS4148 | diode 75V 150mA |
| 14 | L1 | 1 | 2.2mH | inductor, shielded LPS5015 65mA 36R 20% |
| 15 | L2 | 1 | 3.3mH | inductor, shielded Isat=0.45A, Irms=0.35A 20% |
| 16 | Q1 | 1 | SPD01N60C3 | MOSFET, N-channel 600V 6R 150°C |
| 17 | Q2,Q3 | 2 | VN2460N8 | MOSFET, N-channel 600V 20R @ Vgs=10V -55...150°C |
| 18 | Q4,Q5 | 2 | 2N7002 | MOSFET, N-channel 60V 7.5R -55...150°C |
| 19 | R1 | 1 | 470k | resistor, metal film 50V 0.063W 1% |
| 20 | R2 | 1 | 22R | resistor, metal film 50V 0.063W 1% |
| 21 | R3 | 1 | 1k | resistor, metal film 50V 0.063W 1% |
| 22 | R4 | 1 | 0R82 | resistor, metal film 100V 0.125W 1% |
| 23 | R5,R6 | 2 | 2.2k | resistor, metal film TK200 400V 1W 5% -55...125°C |
| 24 | R7,R8,R15 | 3 | 360k | resistor, metal film 500V 0.25W 1% |
| 25 | R9,R14 | 2 | 47k | resistor, metal film 50V 0.063W 1% |
| 26 | R10 | 1 | 180k | resistor, metal film 200V 0.25W 1% |
| 27 | R11 | 1 | 100k | resistor, metal film 50V 0.063W 1% |
| 28 | R12 | 1 | 390R | resistor, metal film 200V 0.25W 1% |
| 29 | R17,R21 | 2 | 10R | resistor, carbon film CMB 0207 500V 1W 5% |
| 30 | R18 | 1 | 15R | resistor, metal film 100V 0.125W 1% |
| 31 | R19 | 1 | 100k | resistor, NTC NTC 20% |
| 32 | R20 | 1 | 27k | resistor, metal film 50V 0.063W 1% |
| 33 | U1 | 1 | HV9961LG | High Brightness LED Driver 8..450V -40...125°C |

Fig.14

LED DRIVER CIRCUIT

This application is a §371 of International Application No. PCT/EP2011/067959 filed Oct. 14, 2011, and claims priority from German Patent Application Nos. 10 2010 042 485.4 filed Oct. 15, 2010, 10 2011 012 672.4 filed Jan. 7, 2011, 10 2011 008 065.1 filed Jan. 7, 2011, 10 2011 016 503.7 filed Apr. 8, 2011 and 10 2011 016 502.9 filed Apr. 8, 2011.

The invention relates to an LED driver circuit—hereinafter "driver"—for controlling and supplying the power to an LED.

LEDs are light-emitting diodes, and the respective electronic driver circuits or driver modules which cause the respective LEDs to light up are known as LED drivers.

The brightness of an LED increases with the power consumption. At a constant semiconductor temperature, the increase is approximately proportional. The efficiency drops with an increase in temperature, so the light yield or luminous efficiency declines at the power limit, depending on the type of cooling. An LED will fail when the temperature of the semiconductor exceeds a maximum of about 150° C.

The power of lights with LEDs may be controlled, for example, by resistance elements or by phase control dimmers. These drivers are always located some distance away from the actual LED, i.e., they are not in the lamp itself. One disadvantage here is that the control of the LED is sluggish due to the distance of the driver from the LED.

LEDs with a high luminous power become so hot during operation that they must be cooled in order not to fail.

WO 2007107601 A1 proposes that for cooling LEDs, they should be arranged on ceramic substrate bodies which are joined in one piece to ceramic heat-dissipating cooling elements, so-called heat sinks. The conductors are applied to the substrate body, so that the substrate body is designed as a circuit board. However, what is special about this is that sintered metallized areas are applied as conductors to the surface of the substrate body. The LEDs are soldered onto the conductors. Therefore this achieves extremely high dissipation of heat, which permits a variable adjustment through the choice of the ceramic.

The object of the present invention is to improve the electric control and power of the LEDs.

The driver circuit according to the invention is defined by the features of patent claim 1. The driver circuit is thus designed for regulating the power supply current to the LED as a function of the temperature of the substrate body of the LED. The driver circuit may therefore have a temperature-dependent resistor, for example, which can be connected to the substrate body in a thermally conducting manner. When the term "driver" is used below, it is always understood to refer to an electric driver circuit.

If the temperature of the LED and/or its immediate environment changes, the brightness of the LED will follow the temperature immediately. Dropping temperatures on the driver (due to wind, shade, reduced radiation) will usually lead to a higher light emission. The speed of the control can be increased further by using a highly heat-conducting ceramic as a substrate of the LED and its driver and can be decreased by using ceramics that are poor conductors, such that the natural (unamplified) fluctuations in brightness are in inverse ratio to the thermal conductivity of the ceramic. Thus, by connecting lamps in series with individual triggering, it is possible to obtain brightness effects in a lamp array, which then make flow effects visible, for example.

One exemplary embodiment of the invention is explained in greater detail below on the basis of the figures, in which.

Figure 5A:
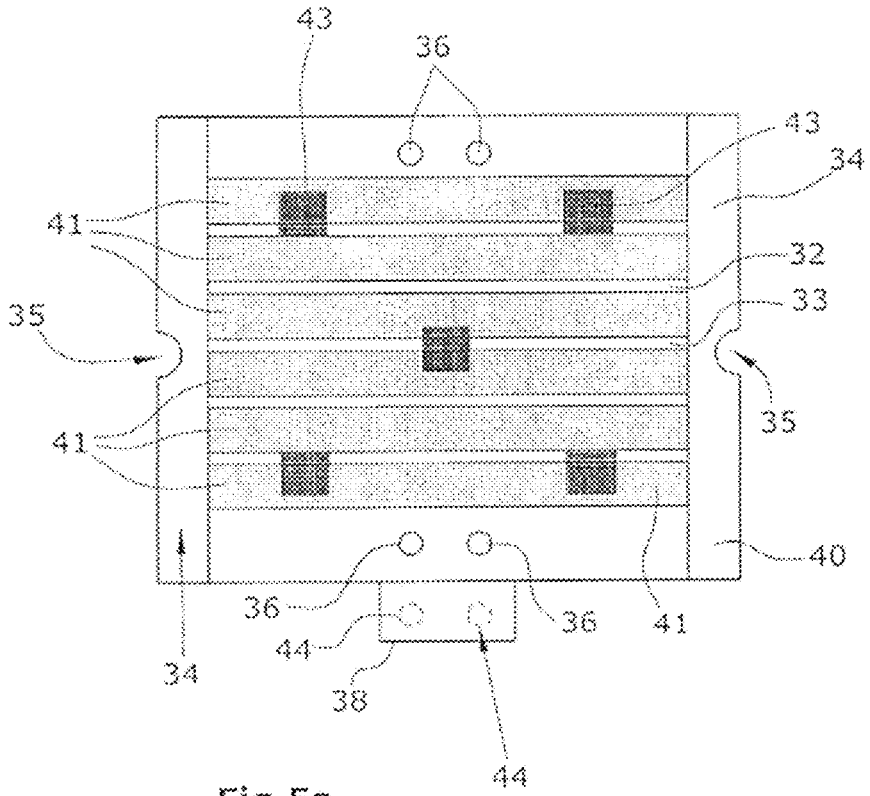
Figure 5B:
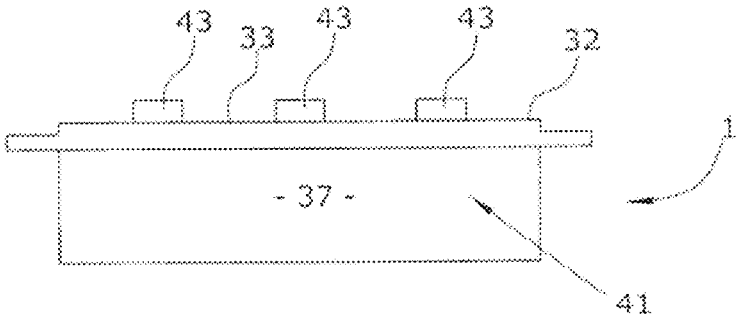
Figure 6:
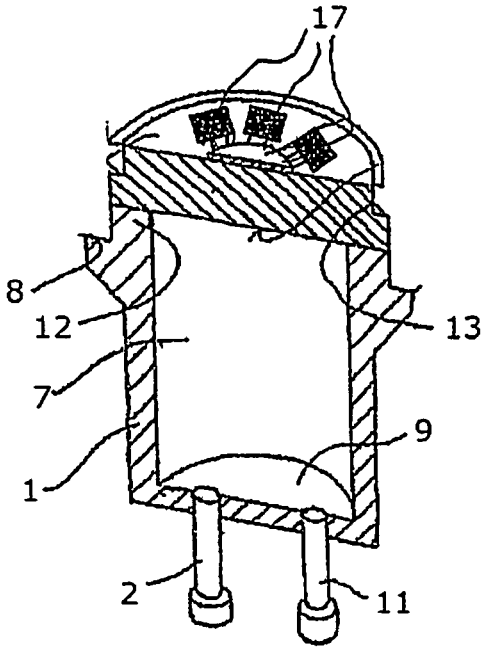
Figure 7:
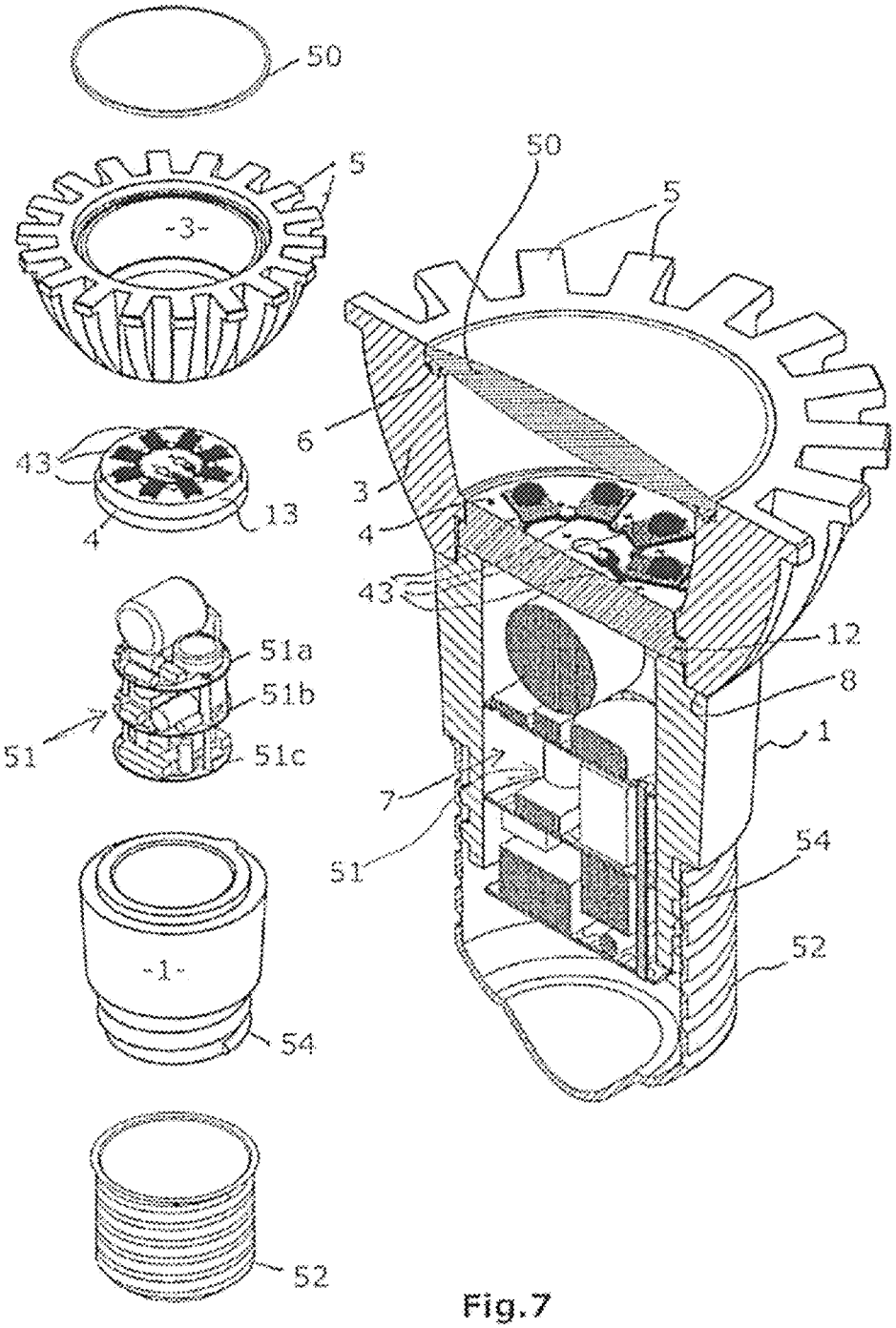

FIGS. 5*a*, 5*b* show another LED lamp,

FIG. 6 shows another LED lamp,

FIG. 7 shows an LED lamp with the inventive driver,

FIGS. 8-13*c* show electronic detailed circuits of the exemplary embodiment according to FIG. 7, and FIG. 14 shows a table with the components used in the electronic circuits of the exemplary embodiment according to FIG. 14.

FIGS. 1 to 3 and 6 show a socket GU10 lamp consisting of a base part 1 with a current feed 2, a lamp shade 3 and a stick-on ceramic mounting substrate 4. The lamp shown in FIG. 6 does not have a lamp shade. Otherwise it is designed just the same as the lamp in FIG. 1.

The mounting substrate 4 in this example is a substrate body and/or mounting disk for the LED and the driver 17; in this example it is made of gray AlN, which has a high thermal conductivity, and the lamp shade 3 is made of a ruby-colored aluminum oxide doped with chromium oxide. The mounting substrate 4 is not visible here. The lamp body and/or lamp shade 3 is/are sealed with a pane of glass (not shown) at the upper end of the lamp shade 3.

Sintered metallized areas 15 are arranged on the surface of the ceramic body 4 for soldering the LED(s). These sintered metallized areas 15 form conductors and thus form a circuit board. For reasons of simplicity, the diodes on the metallized areas 15 are not shown. The drivers 17 are shown only schematically. The drivers 17 in the embodiment shown here are not arranged on the sintered metallized areas 14 or 15 but instead are arranged on the mounting substrate 4. With further miniaturization of the LEDs (2×2 mm is already possible today), the driver may also be mounted directly on the metallized areas 15. Bushings 16 (see FIG. 3) or plug elements (2, 11) for the electric connecting wires are arranged in the mounting substrate 4. These connecting wires are electrically connected to the drivers 17, and the drivers 17 are electrically connected to the metallized areas 15. Any number of metallized areas 15 may be arranged on the mounting substrate 4.

The mounting substrate 4 has a radial indentation 13 on the peripheral surface facing the metallized area 15 for better fixation.

In one variant, the lamp is formed as a module from three ceramic parts, namely a base part 1 with a current feed 2, a mounting substrate 4 and/or mounting disk and a lamp shade 3. For example, electric terminal wires (not shown in the figure) are guided into the base part 1 through the current feed 2, 11 and within the base part 1 up to the drivers 17 and from there to the LEDs. The mounting substrate 4 consists of a ceramic, preferably having a high dissipation of heat. The LED is soldered to the conductors on the mounting substrate 4. The lamp shade 3 is also preferably made of a ceramic with cooling ribs 5 on its outside surface. The cooling ribs 5 extend in the longitudinal direction of the lamp shade 3.

A mounting disk is shown for the mounting substrate 4 in this description. The mounting substrate is the general term because the mounting substrate is only preferably a mounting disk. The mounting substrate may also be designed so it is not disk-shaped. Otherwise both terms describe the same object.

For better fastening of the lamp shade 3 on the base part 1, it has a shoulder 8 on its inside surface with which the lamp shade 3 sits on a corresponding shoulder or indentation 13 on the mounting substrate 4. The lower end of the lamp shade 3 extends around the mounting substrate 4 and the upper end 12 of the base part 1. The mounting substrate 4 is arranged between the lamp shade 3 and the base part 1 in such a way that it is not visible from the outside. The upper end of the lamp shade 3 facing away from the mounting disk 4 has an inner shoulder 6 for receiving a pane of glass. The base part 1 is preferably designed in a cylinder shape with an inner cavity 7. This saves on material.

The lamp thus consists of a base part 1, a mounting disk 4 and a lamp shade 3 surrounding the LED. The light source is attached to the mounting substrate 4.

The base part 1 may also be equipped with corresponding plug receptacles or with a thread for screwing in holders to establish plug connections or in the case of bases equipped with terminal poles, it may also be equipped with a lamp base.

The lamp shade 3 has cooling ribs 5 evenly distributed on its circumference so that the outline of the lamp shade 3 at its opening looks like a gear wheel. The cooling ribs 5 are advantageous with high-power LEDs in particular in order to dissipate the resulting heat to the ambient air. Their cross section may also assume any other possible shape, such as half-round or half-elliptical, for example. In the case of LEDs with low heat losses, the shade may also be smooth. The shade may also have different shapes, for example, it may oval or polygonal.

Figure 2:
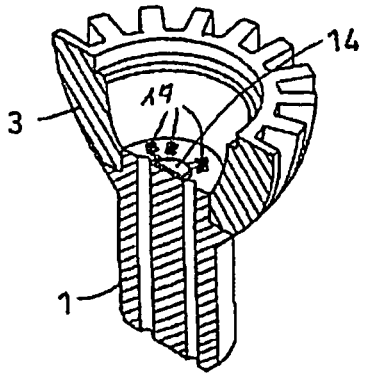
FIG. 2 shows a section through another LED lamp.
Figure 3:
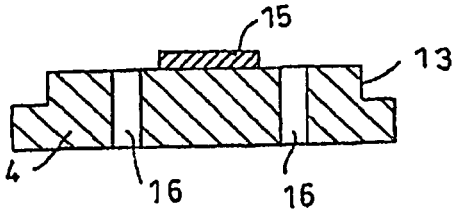
FIG. 3 shows a detail according to FIG. 2.

The base part 1 may also be designed in one piece with the mounting substrate 4 as shown in FIG. 2.

Figure 1:
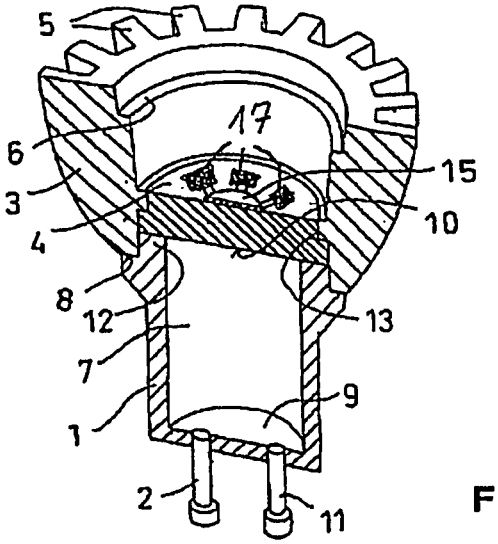
FIG. 1 shows a section through a first LED lamp.

FIG. 6 shows a lamp according to FIG. 1 without the lamp shade 3. This shadeless variant is advantageous because and/or sunlight can influence the driver temperature directly (unshaded) and the LEDs may be reregulated in a very short period of time due to this change in temperature. The same reference numerals in FIGS. 1, 2 and 6 are to show the same object.

Figure 4:
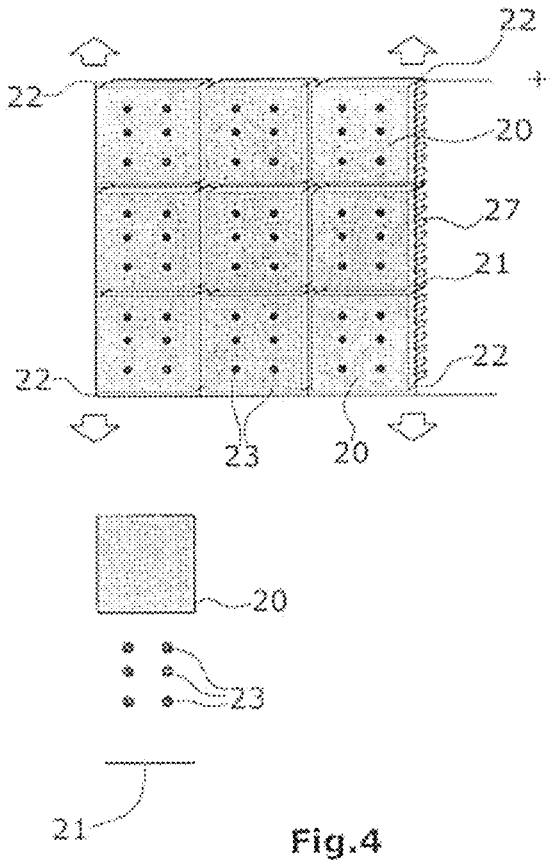
FIG. 4 shows another LED lamp.

FIG. 4 shows an array of nine diode substrates 20 which consist of the ceramic cooling bodies described in WO 2007/107601 A2 (see description introduction) with sintered metallized areas as conductors. Six diodes and/or LEDs 23 are mounted on each diode substrate 20 (shown only schematically) and are also electrically connected to one another via the metallized areas (not shown). The diode substrates 20 have fins 27 for cooling.

FIG. 4 shows square diode substrates 20, but any other shape may also be used. The individual diode substrates 20 are installed or suspended in a metal frame 21 or may also serve as the current feed for the LEDs 23 at the same time. The array of the diode substrates 20 serves to provide large area illumination but can also be used for just point illumination. To do so, the diode substrates 20 are secured at different angles in the metal frame 21 to produce a focused light.

For example, a parabolic arrangement with a focal point of light is formed by folding up the corners 22. The array may also be planar for illumination of an area or may be bent for spot illumination.

At the same time, the driver of the control of the LEDs is preferably also arranged on at least one diode substrate, preferably on each diode substrate 20. This is not shown in the figures. The sintered metallized areas are designed here as conductors on which the LEDs are arranged.

FIGS. 5*a*, 5*b* show a ceramic diode substrate 40 in a view from above (FIG. 5*a*) and in a sectional view (FIG. 5*b*) consisting of a ceramic substrate body 32, which is provided in one piece, having heat dissipating ceramic cooing elements 37, shown here in the form of fins. Sintered metallized areas 41 are applied to the surface 33 of the substrate body 32 so that the diode substrate 40 is a circuit board. LEDs 43 are attached to the diode substrate 40 and are soldered on the metallized areas 41. For current conducting and/or mechanical connection of two or more diode substrates 40 to form an array. The diode substrates 40 have plugs and/or sockets as connecting elements with which the diode substrates 40 are connected directly or indirectly to one another.

In addition to the LEDs, their drivers are also arranged on the diode substrates 40 and are wired to the LEDs accordingly.

In another variant, the plugs are pins 36 in particular according to the GU 5.3 standard and the sockets are adapted to the pins. FIG. 5 shows a variant with only plugs, in this case consisting of pins 36. These pins 36, namely two for each plug, are arranged on the edge area of the diode substrate 40, such that the plugs 36 are situated on opposite sides of the diode substrate 40. A separate connecting element 38 is used here for connecting two diode substrates 40. This connecting element 38 is a rectangular or square-shaped plate with through-bores 44 in the variant shown here. The pins 36 are inserted into these boreholes 44 on the diode substrate 40 establishing an electrical contact. Each connecting element 38 has four boreholes 44. Two boreholes 44 are electrically connected to one another on each connecting element 38.

For fastening the diode substrates 40 in a frame, they have a strip 34 without metallized areas 41 on at least one edge and are without LEDs 43 and driver. This strip 34 thus forms a ceramic spring for fastening on a frame or on a rail. At least two rails then form the frame.

The strip 34 preferably has at least one recess for fastening using preferably a screw.

FIG. 7 shows in a sectional view and in an exploded diagram a lamp with the driver circuit according to the invention. This lamp resembles the lamp in FIG. 1 and is provided for the lamp base E27. This lamp consists of six parts or units namely a metallic threaded socket 52, a ceramic base part 1, an electronic module 51 as a driver for controlling the LEDs 43, a ceramic mounting substrate 4, a ceramic lamp shade 3 with cooling ribs 5 and a glass disk 50.

The base part 1 is designed as a hollow cylindrical body that is open on both ends and is the central substrate body of the lamp. The base part 1 has an outer thread 54 which is indented radially toward the outside wall of the base part 1 on its end which faces away from the lamp shade 3. The threaded socket 52 with its inside thread is screwed onto this outside thread 54. This threaded socket 52 is designed according to the E27 standard and is made of metal.

The electronic module 51 which contains the driver is inserted into the base part 1. The electric connection of the electronic module 51 is only indicated for a better overview. The electronic module 51 is electrically connected to the LEDs 43 on the mounting substrate 4. To this end the mounting substrate 4 has two boreholes through which the electrical connection leads from the electronic module 51 to the LEDs.

The ceramic mounting substrate 4 is glued to the base part 1. The mounting substrate 4 is the substrate body and/or the mounting disk for the LEDs 43 and preferably is made of gray highly heat conductive AlN and the lamp shade 3 is made of ruby-colored aluminum oxide with chromium oxide doping. The mounting substrate 4 is not visible from the outside. The lamp shade 3 is sealed with a pane of glass 50 at the upper end of the lamp shade 3.

On the surface of the ceramic substrate 4, sintered metallized areas are arranged for soldering the LEDs 43. These sintered metallized areas form conductors and therefore form a circuit board. The drivers are arranged on three conductors 51*a*, 51*b*, 51*c* which are in turn arranged vertically one above the other in the electronic module 51. If there is enough space, the drivers are preferably arranged on the sintered metallized areas or on the plain mounting substrate 4. The drivers are electrically connected to the LED.

Any number of metallized areas may be arranged on the mounting substrate 4. In the embodiment in FIG. 7, however, the drivers are arranged in the electronic module 51 which is situated in the cavity 7 in the base part 1. The electronic module 51 is preferably secured in the base part 1 with a thermally conductive electrically insulating casting compound.

The mounting substrate 4 may also be designed so it is not disk-shaped. The mounting substrate 4 has a radial indentation 13 for better fixation. The mounting substrate 4 consists of a ceramic, preferably with a high heat dissipation property. The LED is soldered to the conductors on the mounting substrate 4.

The lamp shade 3 preferably is made of a ceramic with cooling ribs 5 on its outside surface. The cooling ribs 5 extend in the longitudinal direction of the lamp shade 3.

For better mounting of the lamp shade on the base part 1, it has a shoulder 8 on its inside surface with which the lamp shade 3 sits on a corresponding shoulder or indentation 13 on the mounting substrate 4. The lower end of the lamp shade 3 extends around the mounting substrate 4 and the upper end 12 of the base part 1. The base part 1 is preferably designed to be cylindrical with an inner cavity 7. This saves on material and creates space for the electronic module 51.

The base part 1 may also be equipped as a plug for establishing plug connections with corresponding sockets or with threads for screwing them into holders or in the case of sockets with terminal poles, into lamp bases.

The lamp shade 3 has cooling ribs 5 running in the longitudinal direction of the lamp, uniformly distributed around its circumference, so that the outline of the lamp shade 3 looks like a gearwheel at its opening. The cooling ribs 5 are advantageous in particular in the case of high power LEDs to dissipate the resulting heat to the ambient air. Their cross section may also assume any other possible shape such as half round or half elliptical, for example. In the case of LEDs with low heat losses, the shade may also be smooth. The shade may also have different shapes, for example, oval or polygonal.

By using ceramic housing and circuit board components, the electrical insulation is provided and the driver can be connected directly without galvanic separation. Because of the thermal heat conducting properties of the ceramic in conjunction with a heat conducting casting compound and the spatially compact sandwich design (see FIG. 7), this yields a very good overall heat distribution in the interior of the base and/or in the interior of the base part 1. The power loss by the driver itself and the heat generated by the LEDs both reach the electronics with a slight time lag, so then the power supply to the LEDs is linearly down-regulated, so that a freely preselected maximum temperature of the overall system is not exceeded. Thus the driver circuit itself as well as the LEDs are protected from overheating. The better the cooling, the brighter are the LEDs and vice-versa. A thermal overload is largely prevented. In addition, the entire circuit can be dimmed manually with commercial phase control dimmers over a wide range.

Figure 8:
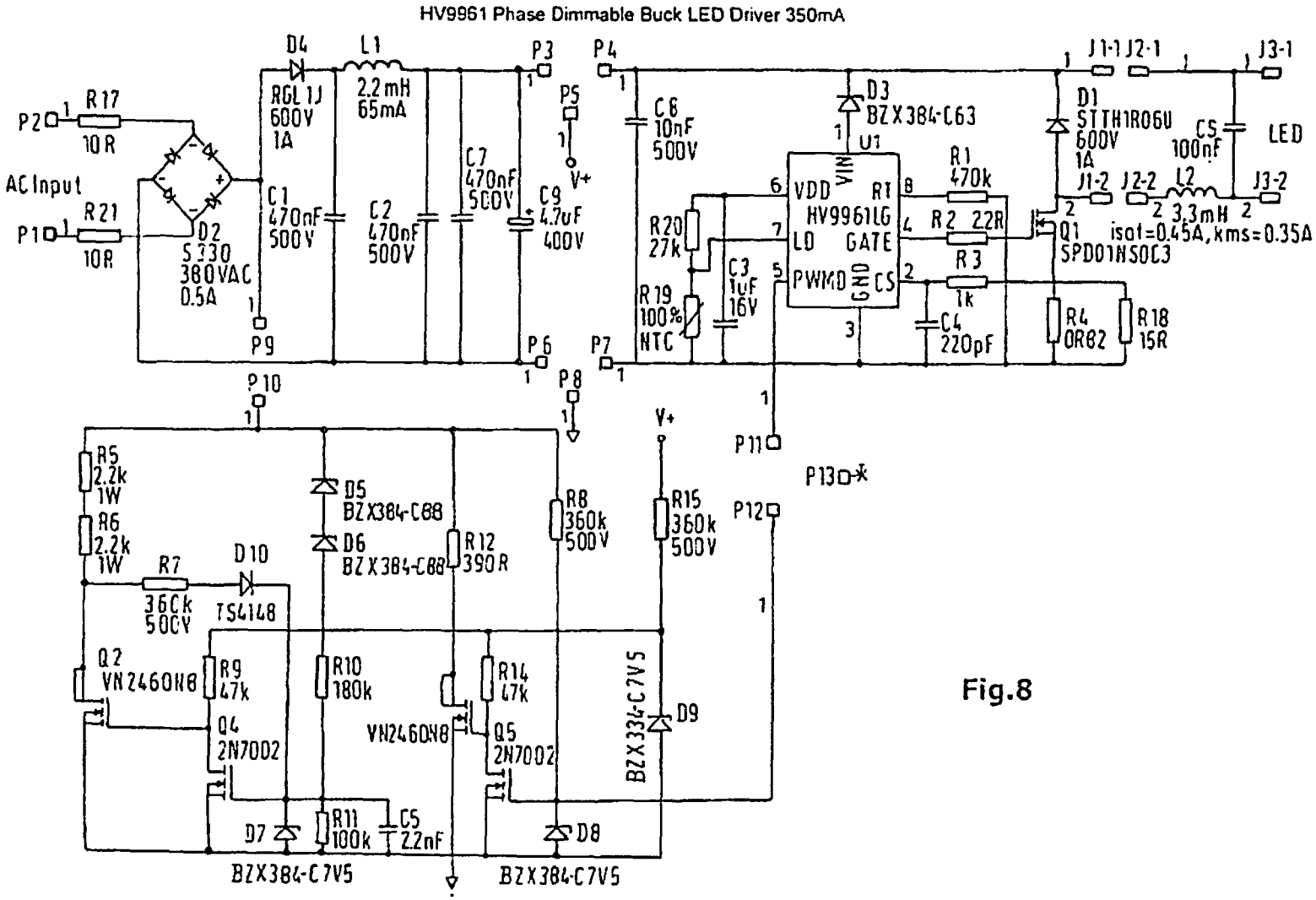

FIG. 8 shows the complete electronic circuit of the drivers, listing the components used in FIG. 14.

Figure 9:
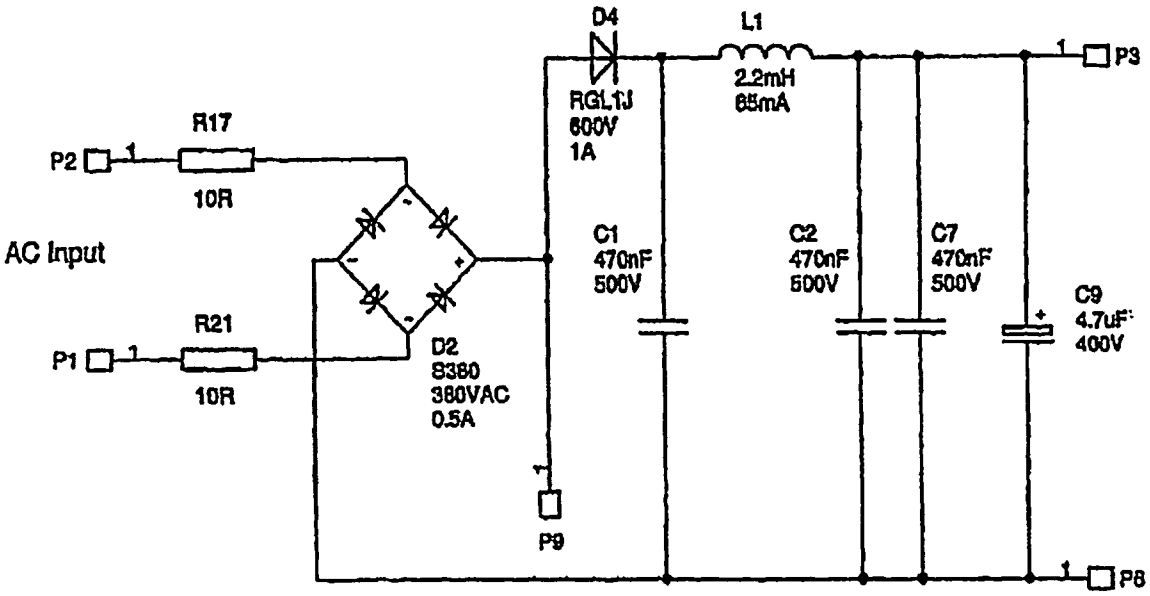

FIG. 9 shows the electronic circuit of the electronic module 51*c* (see FIG. 7). FIGS. 12*a* and 13*a* show a schematic view of the electronic module 51*c* from above and below. The electronic module 51*c* is responsible for the connection to the 230 volt network and has a bridge rectifier with diodes D2. The two resistors R17 and R21 are connected upstream from the bridge rectifier for limiting the input current in order to prevent a short circuit in the event of discharged capacitors. The resistors R17 and R21 also serve as overvoltage protection for network voltages up to 500 volt. The bridge of the bridge rectifier is equipped with smoothing capacitors C1, C2 and C7 which are designed as ceramic capacitors and have a lifetime of up to 500,000 hours of operation. With the capacitors and the coil L1, a filtering effect is achieved to short circuit high interference frequencies. The capacitor C9 is an aluminum electrolyte capacitor for dimming the dc voltage generated.

Figure 10:
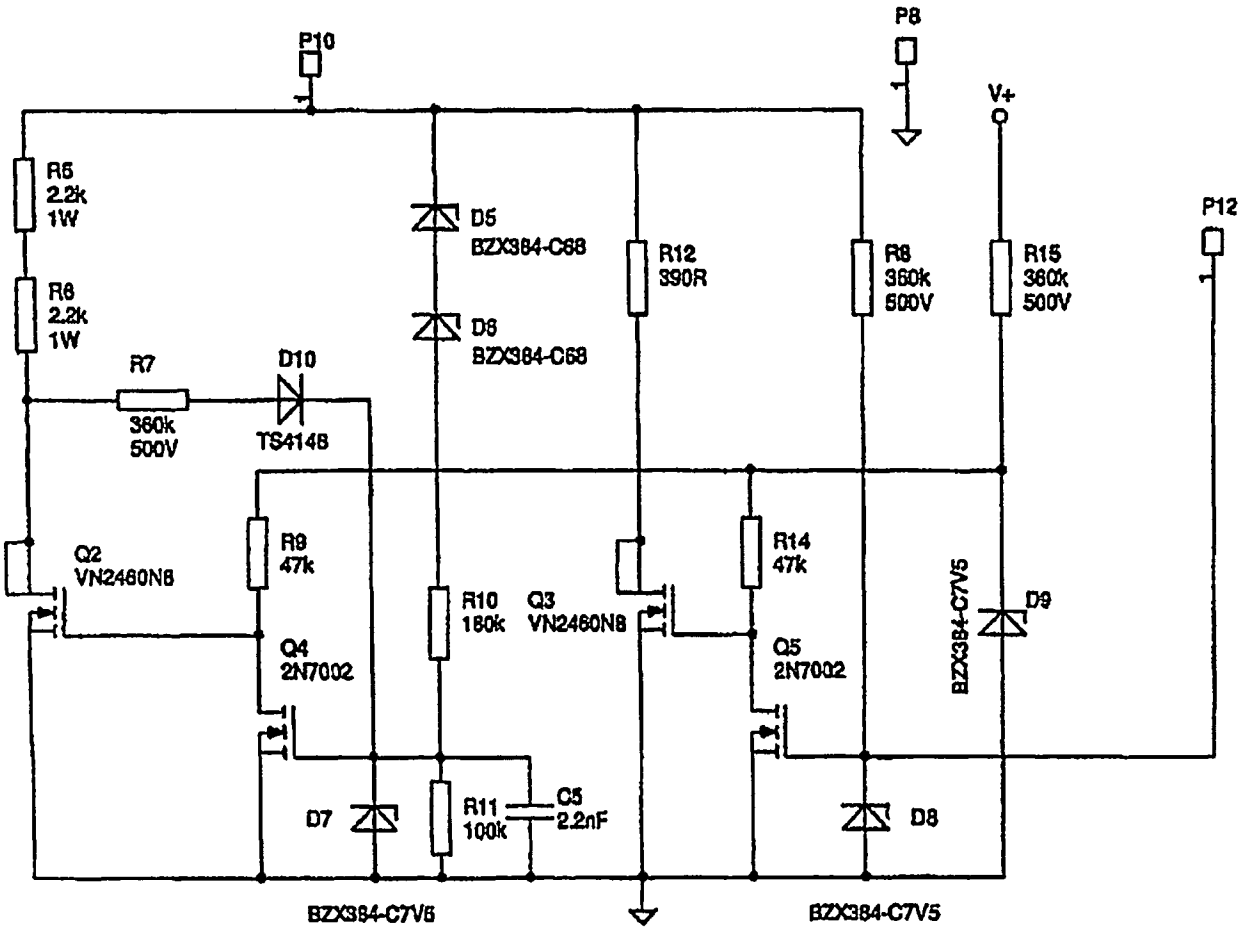

FIG. 10 shows the electronic circuit of the electronic module 51*b* (see FIG. 7). FIGS. 12*b* and 13*b* show a schematic view of the electronic module 51*b* from above and beneath. The electronic module 51*b* is a dimmer circuit for phase control dimming. The dimmer circuit uses voltage dividers, diodes and MOS field effect transistors. The dimmer circuit simulates an ohmic load in the range of approx. 10 watts, so that the power required to operate the dimmers is applied to the dimmers.

Figure 11:
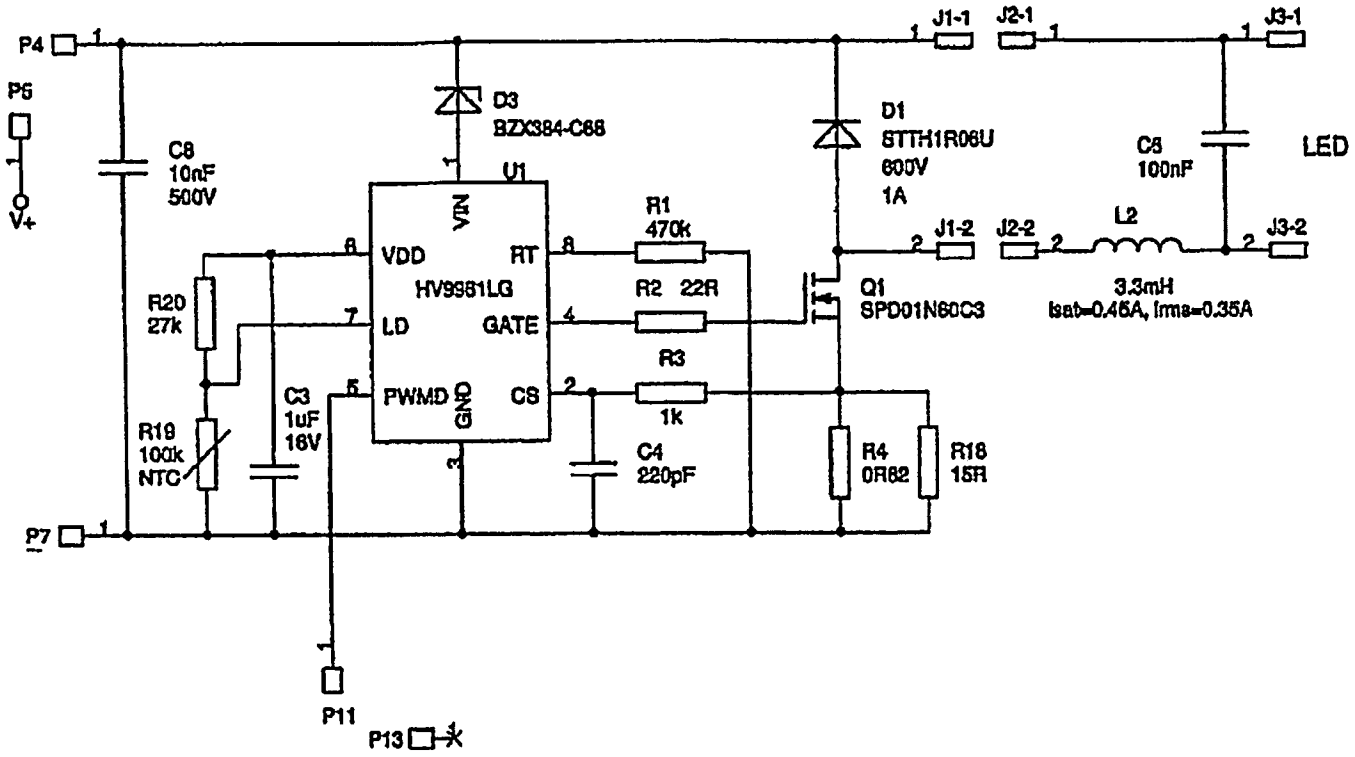
Figure 12:
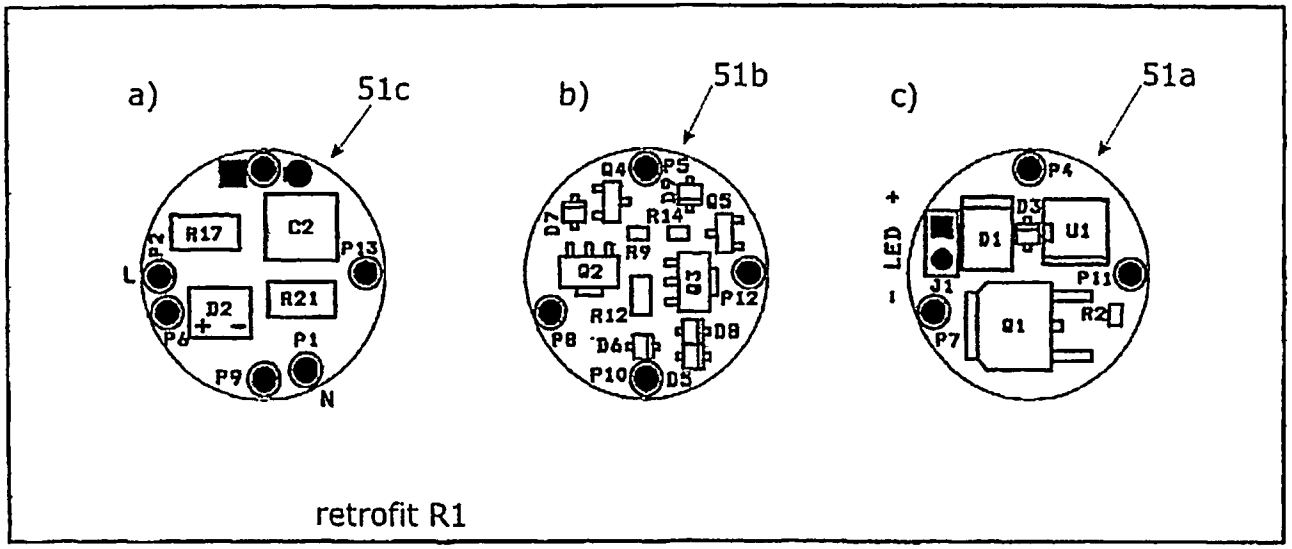
Figure 13:
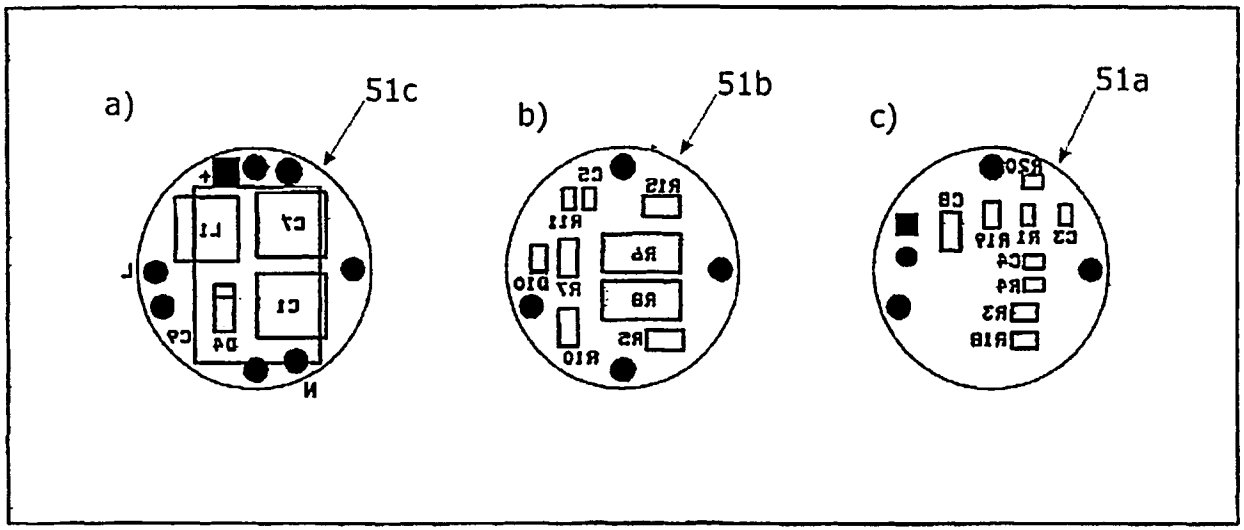

FIG. 11 shows the electronic circuit of the electronic module 51*a* (see FIG. 7). FIGS. 12*c* and 13*c* show a schematic view of the electronic module 51*a* from above and beneath. The electronic module 51*a* has an integrated circuit of the HV9961LG type to control the LED current on the output end. A temperature-dependent resistor (NTC) R19 is arranged at the input 7 of the integrated circuit, generating a control signal for the integrated circuit for control of the LED as a function of temperature. The temperature-dependent dimming takes place using pulse width modulation. The integrated circuit HV9961LG is designed for temperatures from −55° C. to +125° C. with a power class of 10 watts for the military temperature range to achieve a long service life. The integrated circuit generates a power supply voltage for the LED, which is reduced in comparison with the line voltage, such that the remaining voltage is dissipated as heat. At the output end, the integrated circuit is provided with a MOS field effect transistor Q1 and with a throttle coil L2 having an inductance of 3 millihenries. Up to eight LEDs can be operated with the control circuit according to FIG. 11.

The advantages thus include:

1. Optimal protective insulation due to the use of ceramic materials.
2. Optimal dissipation of heat due to the use of ceramic materials.
3. Attractive design due to the use of ceramic materials as the housing.
4. Overheating protection due to installed electronic module 51 and/or NTC thermally coupled by casting.

The invention claimed is:

1. An LED driver circuit for controlling power and supplying power to an LED having a ceramic substrate body, wherein said ceramic substrate body has a temperature, wherein the LED driver circuit regulates the power supply current of the LED as a function of the temperature of the ceramic substrate body, wherein the LED driver circuit comprises a bridge rectifier with diodes, and two resistors upstream of the bridge rectifier for limiting current input, and wherein the bridge rectifier comprises ceramic capacitors and an aluminum electrolyte capacitor for dimming DC voltage generated.

2. The LED driver circuit according to claim 1, wherein the LED driver circuit comprises at least two circuit boards arranged such that the at least two circuit boards are stacked one above the other.

3. The LED driver circuit according to claim 2, wherein the LED driver circuit has three stacked circuit boards such that a first stacked circuit board forms a preliminary stage, a second circuit board forms a temperature-controlled dimmer stage and a third circuit board forms an output stage for the power supply current of the LED.

4. The LED driver circuit according to claim 3, wherein the first circuit board has as the preliminary stage the bridge rectifier circuit having smoothing capacitors and having a filter circuit in the bridge rectifier.

5. The LED driver circuit according to claim 4, wherein the second circuit board has at least ohmic voltage divider to simulate at least an ohmic load of approximately 5-20 watts.

6. The LED driver circuit according to claim 4, wherein the second circuit board has at least ohmic voltage divider to simulate at least an ohmic load of approximately 5-20 watts.

7. The LED driver circuit according to claim 4, wherein third circuit board has a temperature-dependent resistor, which supplies the LED with a reduced power supply voltage in comparison with a line voltage as a function of temperature.

8. The LED driver circuit according to claim 4, wherein third circuit board has a temperature-dependent resistor, which supplies the LED with a reduced power supply voltage in comparison with a line voltage as a function of temperature.

9. The LED driver circuit according to claim 3, wherein the second circuit board has at least ohmic voltage divider to simulate at least an ohmic load in an area of approximately 5-20 watts.

10. The LED driver circuit according to claim 9, wherein third circuit board has a temperature-dependent resistor, which supplies the LED with a reduced power supply voltage in comparison with a line voltage as a function of temperature.

11. The LED driver circuit according to claim 3, wherein third circuit board has a temperature-dependent resistor, which supplies the LED with a reduced power supply voltage in comparison with line voltage as a function of temperature.

12. The LED driver circuit according to claim 11, wherein the third circuit board has an integrated circuit to control LED current and is designed for a temperature range between −55° C. and +125° C., and the temperature-dependent resistor is connected to its input.

13. The LED driver circuit according to claim 12, wherein at least one of a MOS field effect transistor or a throttle coil is arranged between an output of the integrated circuit and the LED.

* * * * *